US007798064B1

(12) United States Patent
Taylor

(10) Patent No.: US 7,798,064 B1
(45) Date of Patent: Sep. 21, 2010

(54) COMMAND AND ARM FUZE ASSEMBLY HAVING SMALL PISTON ACTUATOR

(75) Inventor: Norman C. Taylor, Davenport, FL (US)

(73) Assignee: DSE, Inc., Tampa, FL (US)

( * ) Notice: Subject to any disclaimer, the term of this patent is extended or adjusted under 35 U.S.C. 154(b) by 707 days.

(21) Appl. No.: 11/740,567

(22) Filed: Apr. 26, 2007

(51) Int. Cl.
*F42C 15/24* (2006.01)

(52) U.S. Cl. ..... 102/251; 102/237; 102/245; 102/254

(58) Field of Classification Search ..... 102/221, 102/222, 226, 228, 231, 232, 233, 235, 237, 102/238, 244, 245, 247, 248, 251, 254, 255
See application file for complete search history.

(56) References Cited

U.S. PATENT DOCUMENTS

| | | | | |
|---|---|---|---|---|
| 2,969,737 | A * | 1/1961 | Bild | 102/229 |
| 3,157,125 | A | 11/1964 | Lohmann | |
| 3,450,049 | A | 6/1969 | Dare | |
| 3,498,225 | A | 3/1970 | Voida et al. | |
| 3,500,747 | A | 3/1970 | Parker | |
| 3,545,382 | A | 12/1970 | Abt | |
| 3,554,128 | A | 1/1971 | Warren et al. | |
| 3,613,595 | A | 10/1971 | Blomgren et al. | |
| 3,658,009 | A | 4/1972 | Allen | |
| 3,906,861 | A | 9/1975 | Hamilton | |
| 3,962,974 | A | 6/1976 | Anderson et al. | |
| 3,994,231 | A | 11/1976 | Rudeen et al. | |
| 4,029,016 | A | 6/1977 | Cole | |
| 4,091,735 | A | 5/1978 | Martwick et al. | |
| 4,240,351 | A | 12/1980 | San Miguel | |
| 4,296,689 | A | 10/1981 | Hardesty | |
| 4,372,212 | A | 2/1983 | Hoelzen et al. | |
| 4,478,147 | A | 10/1984 | Hennings et al. | |
| 4,494,459 | A | 1/1985 | Ziemba | |
| H0124 | H * | 9/1986 | Antonuzzi et al. | 102/254 |
| 4,679,503 | A | 7/1987 | Rudenauer et al. | |
| 4,730,559 | A | 3/1988 | Brightman | |
| 4,754,686 | A | 7/1988 | Guitaut et al. | |
| 4,796,532 | A | 1/1989 | Webb | |
| 4,869,172 | A | 9/1989 | Webb | |
| 4,896,607 | A | 1/1990 | Hall et al. | |
| 4,899,659 | A | 2/1990 | Hardt | |
| 4,986,184 | A | 1/1991 | Kude | |
| 5,081,929 | A | 1/1992 | Mertens | |
| 5,269,223 | A | 12/1993 | Mattsson et al. | |
| 5,271,327 | A | 12/1993 | Filo et al. | |
| 5,275,107 | A | 1/1994 | Weber et al. | |
| 5,279,226 | A | 1/1994 | Ritchie et al. | |

(Continued)

*Primary Examiner*—Benjamin P Lee
(74) *Attorney, Agent, or Firm*—Ronald E. Smith; Smith & Hopen, P.A.

(57) ABSTRACT

A command to arm apparatus includes a housing having a hollow interior. A pivotally-mounted rotor is disposed in the hollow interior. The rotor has a first, safe position of rotational adjustment that prevents detonation of an explosive and a second, armed position of rotational adjustment that enables detonation of an explosive. A locking cam is pivotally mounted to the rotor and has a rotor-locking position of repose. The rotor is free to rotate from its safe position to its armed position when the locking cam is rotated out of the rotor-locking position by a piston that extends from a piston actuator. The rotor abuts a flat formed in a sidewall of the housing and can rotate no further when the device is in the armed configuration.

10 Claims, 8 Drawing Sheets

U.S. PATENT DOCUMENTS

| | | | |
|---|---|---|---|
| 5,612,505 | A | 3/1997 | O'Braskey et al. |
| 5,693,906 | A | 12/1997 | Van Sloun |
| 5,821,447 | A | 10/1998 | Reams et al. |
| 6,142,080 | A | 11/2000 | Ziemba |
| 6,145,439 | A | 11/2000 | Ziemba |
| 6,321,654 | B1 | 11/2001 | Robinson |
| 6,374,739 | B1 | 4/2002 | Smith et al. |
| 6,439,119 | B1 | 8/2002 | Smith et al. |
| 6,568,329 | B1 | 5/2003 | Robinson |
| 7,124,689 | B2 | 10/2006 | Davis et al. |
| 2002/0069784 | A1 | 6/2002 | Landman et al. |
| 2003/0024427 | A1 | 2/2003 | Alculumbre et al. |
| 2003/0037691 | A1 | 2/2003 | Steele et al. |
| 2005/0081732 | A1 | 4/2005 | Worthington |
| 2006/0107862 | A1 | 5/2006 | Davis et al. |
| 2006/0124018 | A1 | 6/2006 | Graham et al. |

* cited by examiner

COMMAND AND ARM FUZE ASSEMBLY HAVING SMALL PISTON ACTUATOR

BACKGROUND OF THE INVENTION

1. Field of the Invention

This invention relates to command to arm devices for bullets and rockets.

2. Description of the Prior Art

Conventional safe and arm (S&A) devices have a large spread in the distance between "no arm" and "all arm." Typically, the "all arm" distance is three (3) to four (4) times the "no arm" distance. The "all arms" distance may therefore be hundreds of feet, a distance that is unacceptable in urban warfare.

Much of the large-spread-in-distance problem resides in the use of mechanical timers that employ verge escapements.

A verge escapement typically includes a star wheel. The assembly is somewhat bulky and its use results in a safe-and-arm device that occupies an unacceptable amount of space. More importantly, the mechanical structure of such escapements is subject to the effects of friction. Accordingly, such mechanisms are inherently inaccurate.

Electrical timers in rounds have been used to explode a warhead after the lapse of a predetermined time after firing so that the explosion occurs when the round arrives at the target. They have not been used to arm a safe and arm device after a prescribed time.

There is a need, therefore, for an improved safe-and-arm device having a thin profile so that it occupies a minimal amount of space. More particularly, there is a need for such a device that does not require a verge escapement mechanism.

There is also a need for a device having an electrical timer that arms a safe-and-arm device after a prescribed time. More particularly, there is a need for a device that substantially eliminates the distance between the "no arm" and the "all arm" states.

However, in view of the art considered as a whole at the time the present invention was made, it was not obvious to those of ordinary skill in this art how the identified needs could be met.

SUMMARY OF INVENTION

The long-standing but heretofore unfulfilled need for am improved safe and arm device is now met by a new, useful, and nonobvious invention.

Missiles that carry warheads include safe and arm (S&A) devices that prevent the warhead from exploding during the flight of the missile to a target. The flight time from launch to impact is the "no arm" time. At the end of the "no arm" time, the S&A device reconfigures itself into an "all arm" configuration, thereby arming the warhead so that it can explode at the target site. It is thus understood that it is important to minimize the amount of time that passes between the respective "no arm" and "all arm" configurations.

The novel device arms the warhead microseconds after it receives an electrical signal to arm after a flight time equivalent to the "no arm" distance. The "no arm" and "all arm" distances are therefore made substantially equal to one another.

The electrical signal initiates an explosive actuator at the "no arm" distance. The explosion causes mechanical movement of an actuator piston. The moving piston bears against and releases a mechanical lock of the rotor that contains an explosive lead or detonator. The rotor is held in its safe position by said lock during flight. The rotor moves from the safe position to the armed position in microseconds due to centrifugal force and the absence of an escapement.

An important object of the invention is to eliminate the spread between "no arm" and "all arm" distances of conventional safe and arm devices.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

The command to arm/safe and arm device assembly ensures that a warhead can not explode until after a round has reached the specified no arm distance for the round.

Figure 1:
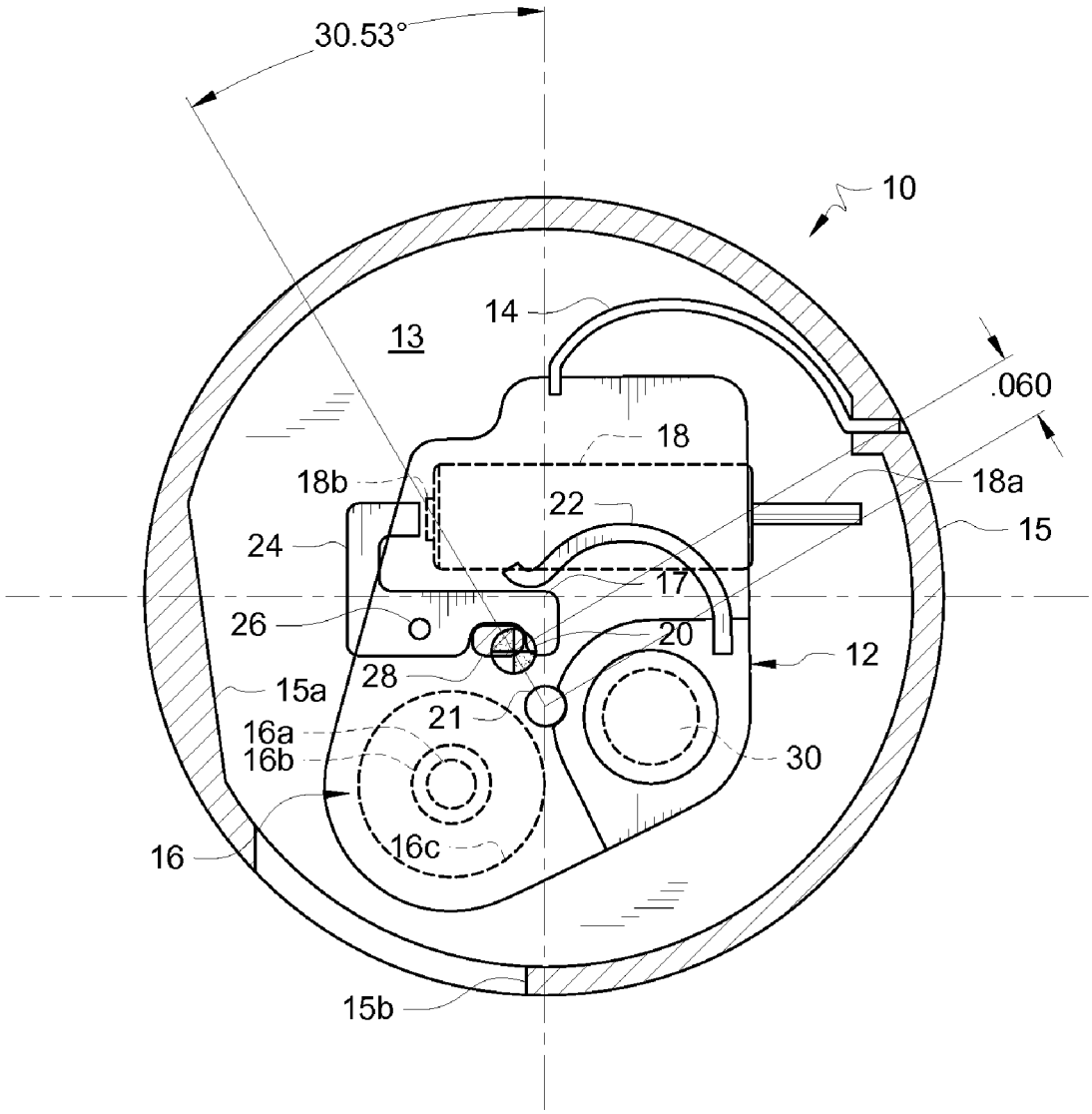
FIG. 1 is a top plan view depicting the novel command-and-arm system with the cover of its housing removed and with the rotor in the safe position.
Figure 2:
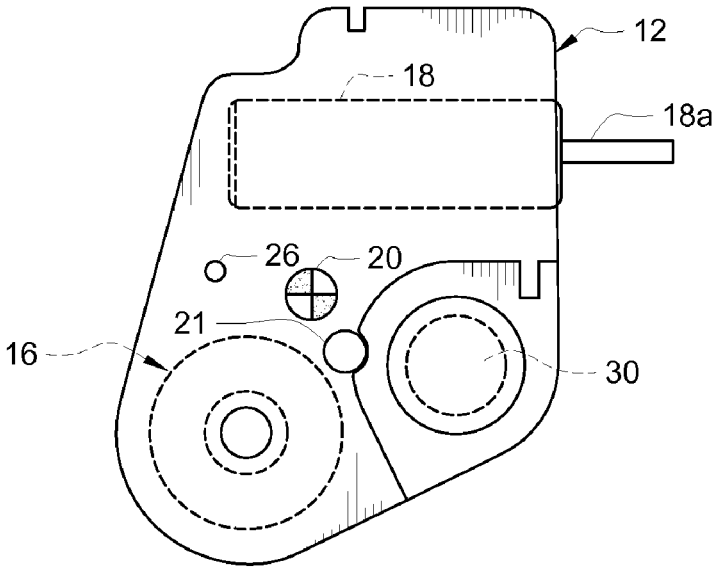
FIG. 2 is a top plan view of the rotor, piston actuator, explosive lead, setback pin/spring system, and release cam pivot pin.

Referring now to FIGS. 1 and 2, it will there be seen that an illustrative embodiment of the novel command to arm system is denoted as a whole by the reference numeral 10. Command to arm housing 10 has a hollow interior defined by cover 11, depicted in FIG. 3, bottom wall 13, and substantially circular sidewall 15. Flat 15*a* and opening 15*b* are formed in said sidewall 15. Center point 17 is the longitudinal axis of symmetry of housing 10. It is indicated by vertical line 17*a* and horizontal line 17*b* that pass through said longitudinal axis of symmetry.

Rotor 12 is depicted in FIG. 1 in the safe position as manufactured. It is held by two different locks as required by governmental safety regulations. These locks unlock the rotor upon gun launch.

First lock 14 is a centrifugal lock spring that releases rotor 12 when the revolutions per second (rps) of a round has reached three hundred revolutions per second (300 rps). The round achieves six hundred revolutions per second (600 rps) at muzzle exit at which time there are ample revolutions per second to release spring 14 which requires only 300 rps to unlock the rotor. Spring 14 does not release before muzzle exit because the setback forces are sufficiently high prior to round exit to deflect spring 14 aft and the friction from this aft force prevents said spring from unlocking rotor 12 until gun exit when the setback force is no longer present.

Second lock 16 is a conventional Objective Crew Served Weapon (OCSW) standard setback/spring system positioned in a standard location that unlocks rotor 12 when it is subjected to thirty thousand times the force of gravity (30,000 Gs) in the gun barrel. Setback system 16 includes setback pin 16*a*, setback spring 16*b* and spacer ring 16*c*. An OSCW receives a setback acceleration of at least sixty thousand times the force of gravity (60,000 Gs) in the gun barrel. Setback pin/spring system 16, like first lock 14, is released when the gun is fired.

Explosive piston actuator 18 is unique in its small diameter and small weight of explosive. It has a positive electrode 18*a* that is adapted to contact an electrical contact attached to the housing. It has no "O" rings.

Piston actuator 18 is mounted close to longitudinal axis of symmetry 17 of the round because at six hundred fifty revolutions per second (650 rps) the centrifugal acceleration is so high that the forces acting on piston actuator 18 make it impossible to operate if it is not near said longitudinal axis of symmetry 17, it being understood that said axis is the axis of rotation of the round. The size of the charge must be increased if piston actuator 18 is mounted too far from said longitudinal axis 17, and such charge could damage said piston actuator.

Accordingly, the center of gravity of rotor 12 is positioned at its optimal location, denoted 20 in this embodiment. Said center of gravity is southwest of longitudinal or rotational axis 17. Rotor 12 pivots about rotor pivot pin 21 which is positioned southeast of center of gravity 20 and due south of axis 17. The mass of rotor 12, when optimally positioned as illustrated, therefore generates a small but adequate counterclockwise torque that drives rotor 12 from the safe, FIG. 1 position, to the armed, FIG. 8 position when the locking cam, hereinafter disclosed, unlocks said rotor.

A five foot (5 ft) drop spring 22 restrains the above-mentioned locking cam 24 in a locked position after a five foot drop and vibration. The amount of restraint thereby provided may be overcome by piston actuator 18.

Locking cam 24 is pivotally mounted about locking cam pivot pin 26 but locking post 28 limits to a small amount the rotation of locking cam 24 that is possible prior to actuation of piston actuator 18. The abutting engagement between locking cam 24 and locking post 28 has sufficient play to allow a small amount of clockwise or counterclockwise rotation of rotor 12 when piston actuator 18 is not actuated as more fully disclosed below.

Figure 3:
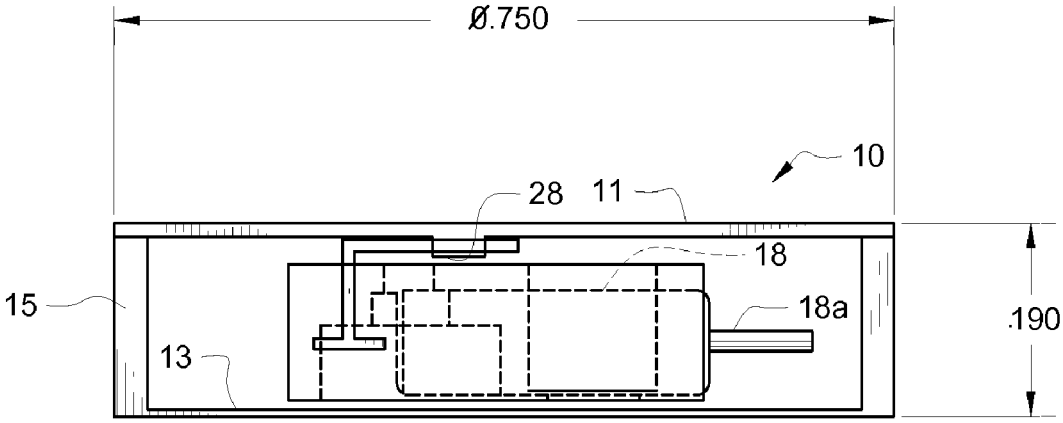
FIG. 3 is a side elevational view of the novel assembly.

The novel structure is depicted in side view of FIG. 3. It has a thickness equal to about sixty percent (60%) of the thickness of a conventional runaway. More particularly, the thickness is about 0.190 inch. This reduction in thickness is a result of several factors, including but not limited to elimination of a mechanical star wheel and verge escapement structure of the type commonly found in prior art safe-and-arm devices, positioning piston actuator 18 closer to longitudinal axis 17 so that it can be smaller and operate with a smaller charge as mentioned above, the provision of low profile locking cam 24, and so on.

Figure 4:
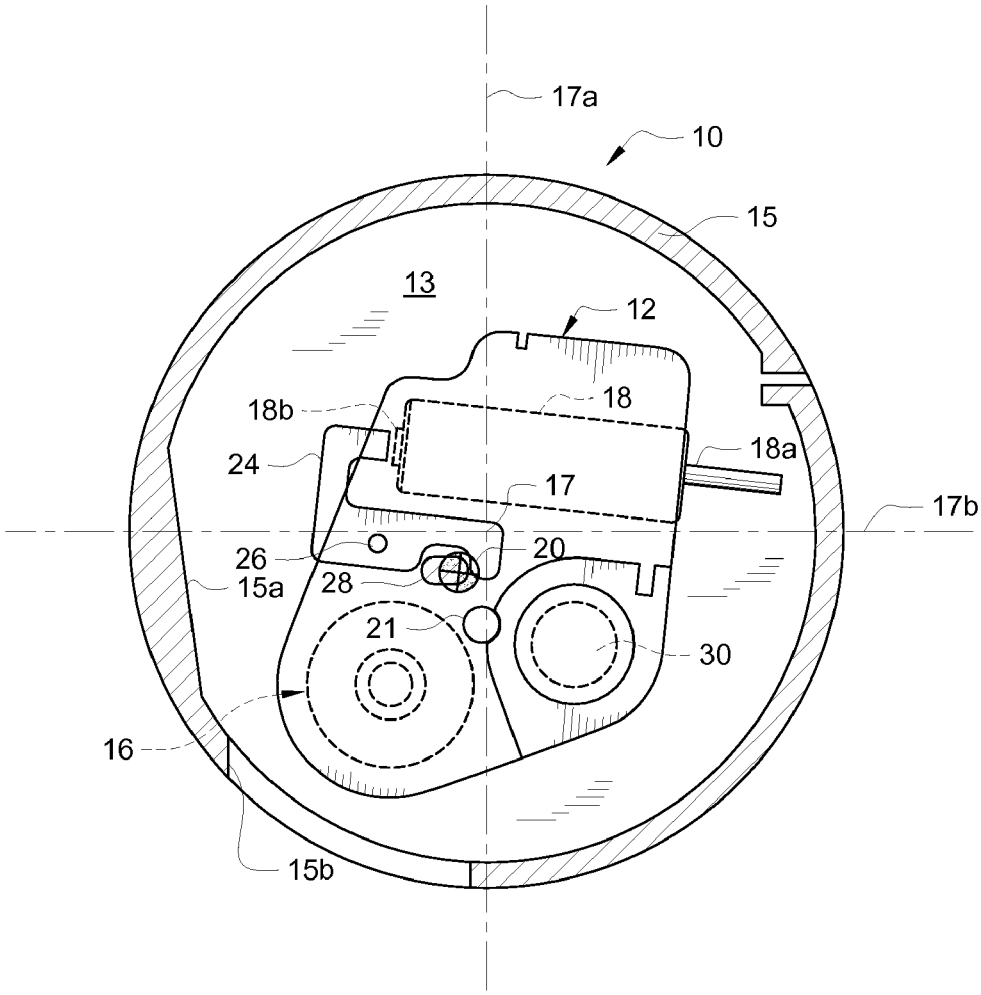
FIG. 4 is a top plan view depicting the locking cam engaging the locking post after the rotor has rotated a very small amount in a clockwise direction.

FIG. 4 depicts a first locked position. The clockwise rotation of rotor 12 about rotor pivot point 21 from the safe configuration of FIG. 1 to the locked configuration of FIG. 4 is a small rotation, limited by locking post 28. Said locking post is formed integrally with and depends from cover 11 as best understood in connection with FIG. 3. This rotation is caused by a round spinning in a clockwise direction. Rotor center of gravity 20 is still northwest of rotor pivot point 21 in FIG. 4, but the small clockwise rotation brings said center of gravity 20 closer to vertical centerline 17*a*.

Figure 5:
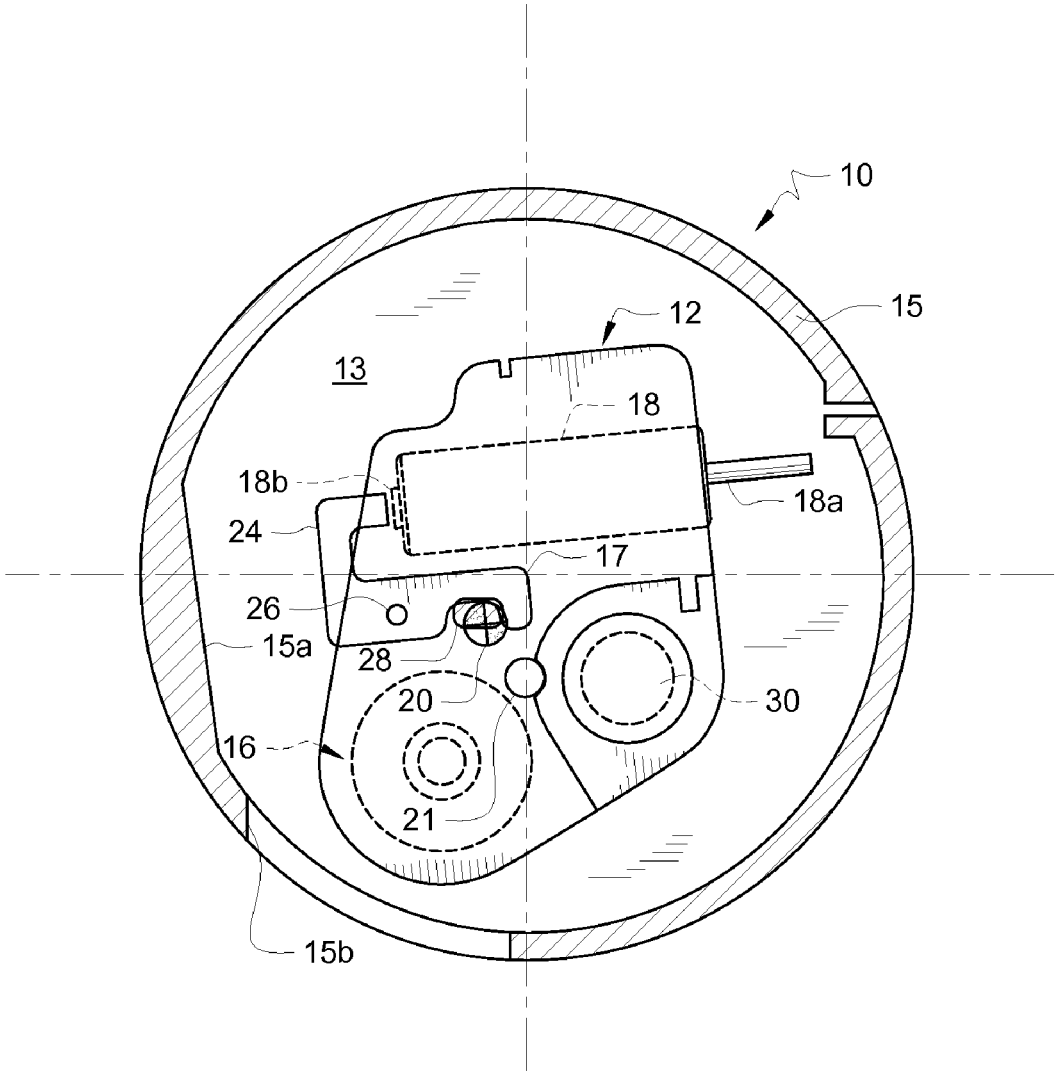
FIG. 5 is a top plan view depicting the locking cam engaging the locking post after the rotor has rotated a very small amount in a counterclockwise direction.

FIG. 5 depicts a second locked position. The small counterclockwise rotation of the rotor from the safe configuration of FIG. 1 to the locked configuration of FIG. 5 is a small rotation, limited by locking post 28. This rotation is caused by a round spinning in a counterclockwise direction. Rotor center of gravity 20 is still northwest of rotor pivot point 21 in FIG. 5, but the small counterclockwise rotation moves said center of gravity 20 further from vertical centerline 17*a*.

Figure 6:
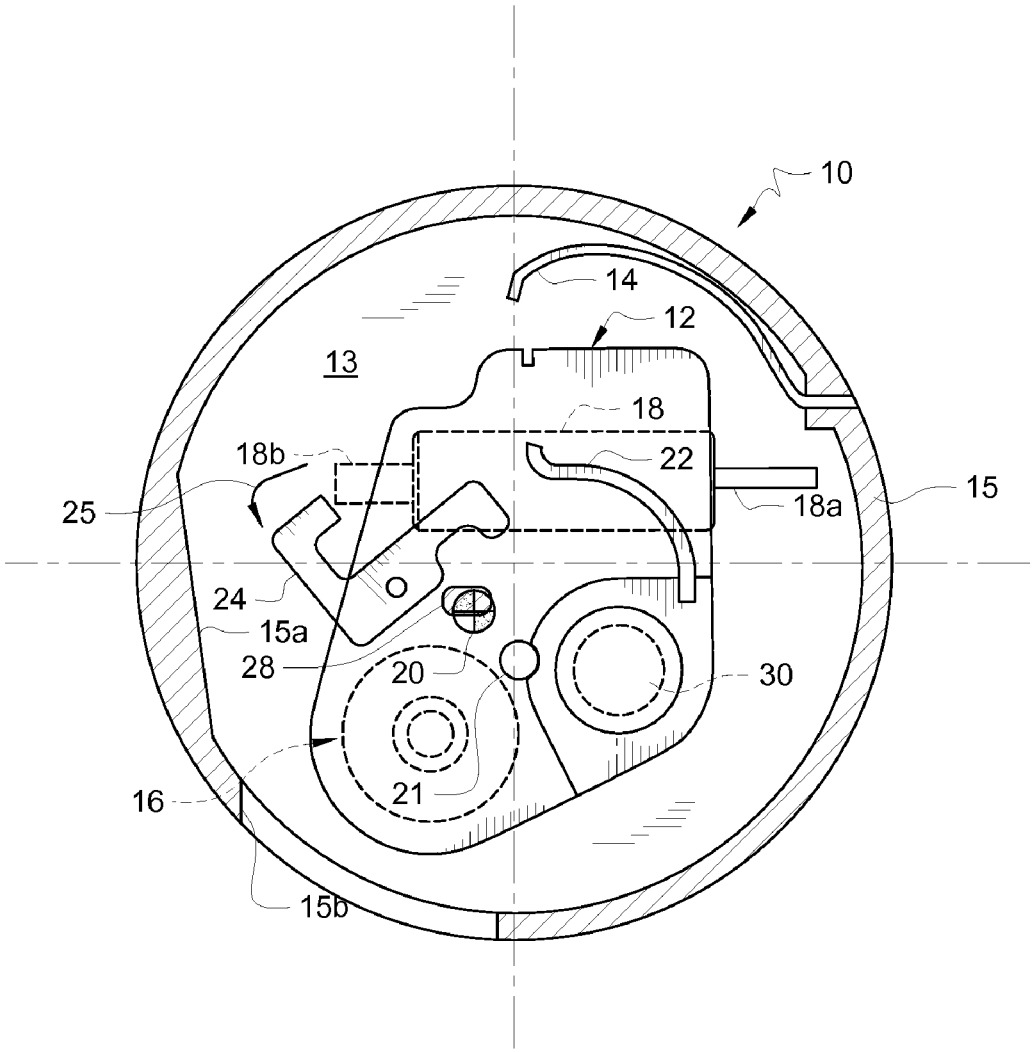
FIG. 6 is a top plan view depicting the actuator piston in its extended position, said configuration being caused by firing the piston actuator in response to an electrical signal delivered by a timer at the instant the round achieves the no arm distance.
Figure 7:
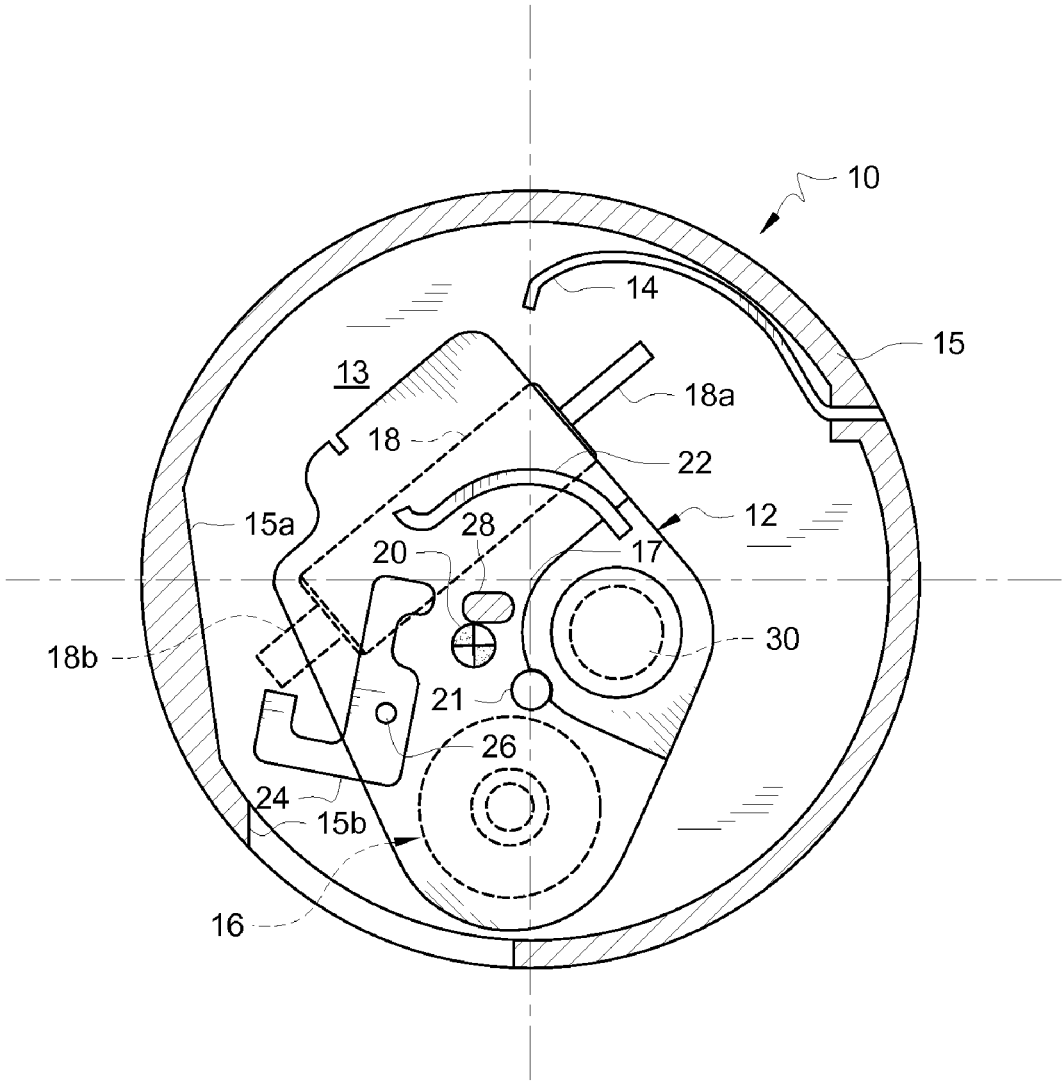
FIG. 7 is a top plan view depicting partial rotation of the rotor toward the armed position.
Figure 8:
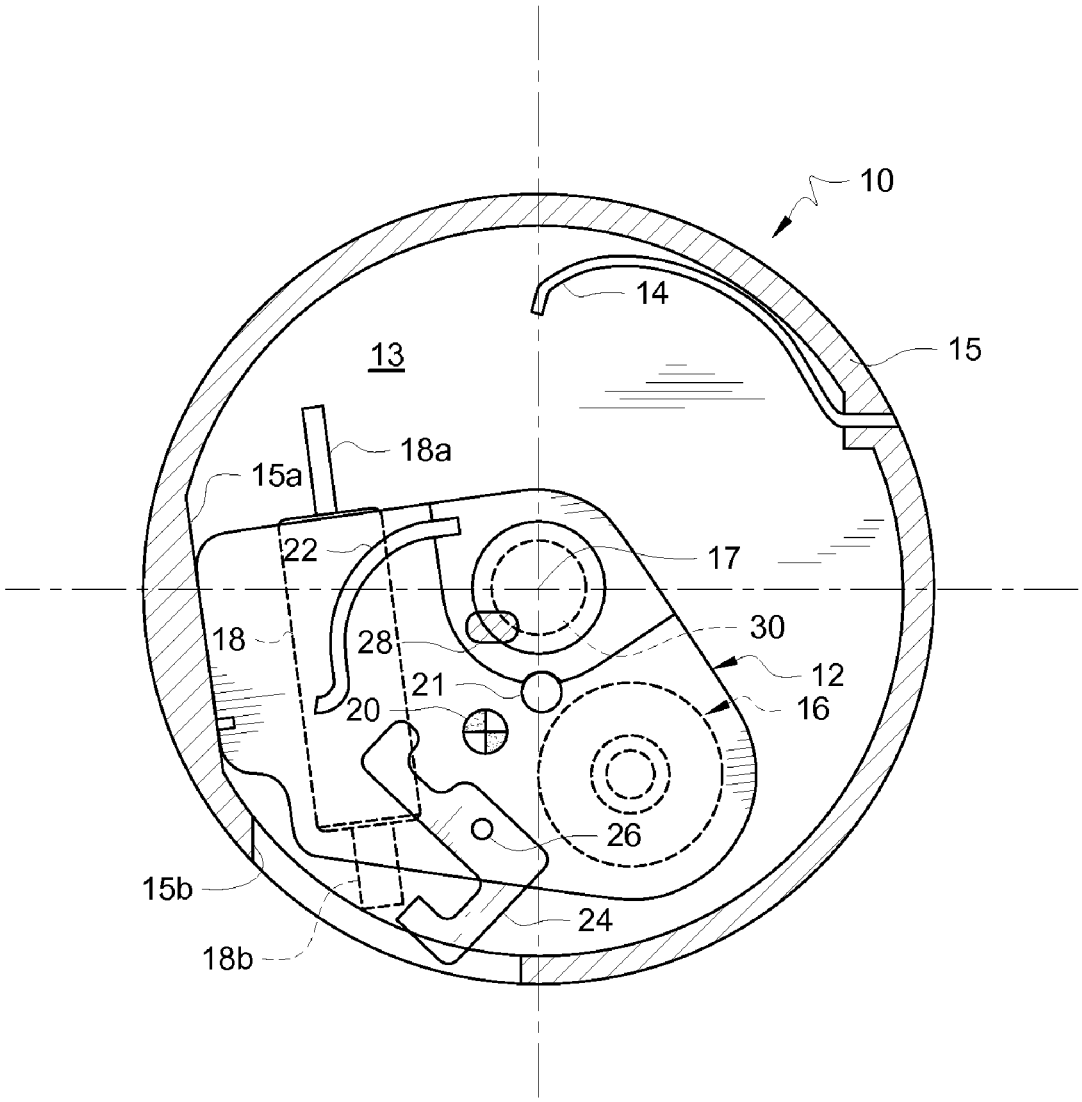
FIG. 8 is a top plan view depicting the rotor in the fully rotated, fully armed position.

Piston 18*b* has a retracted position, as depicted in FIGS. 1-5, and an extended position, as depicted in FIGS. 6-8. Electrical initiation of piston actuator 18 in response to a signal from a timer causes piston 18*b* to extend to the left as drawn in FIG. 1, i.e., to travel from its retracted position to its extended position. Such displacement of piston 18*b* rotates locking cam 24 in a counterclockwise direction, indicated by directional arrow 25 in FIG. 6, thereby unlocking rotor 12 as depicted in FIGS. 6-8. The timer measures the time from the moment of firing to the moment the round reaches a predetermined no arm distance.

Explosive lead 30 ignites the warhead when the electric detonator in the fuse, not depicted, ignites said explosive lead when rotor 12 is in the FIG. 8, armed position.

Partial rotation of rotor 12 as a result of the unlocking by cam lock 24 is depicted in FIG. 7. Note the rotation of rotor 12 about rotor pivot point 21 from the FIG. 6 position to the FIG. 7 position and note further how center of gravity 20 of rotor 12 rotates counterclockwise about rotor pivot pin 21.

FIG. 8 depicts rotor 12 in its fully rotated, fully armed position with explosive lead 28 centered on longitudinal axis 17 of command-and-arm device 10. Note the further rotation of rotor 12 about rotor pivot point 21 from the FIG. 7 position to the FIG. 8 position. Flat 15*a*, formed in a radially inwardly facing side of sidewall 15, blocks further rotation of rotor 12. Opening 15*b*, formed in said sidewall 15, accommodates locking cam 24 by providing clearance space when rotor 12 is in said fully rotated, fully armed position. Significantly, the centrifugal forces generated by spinning of the round also operate to urge rotor 12 against flat 15*a*.

Figure 9:
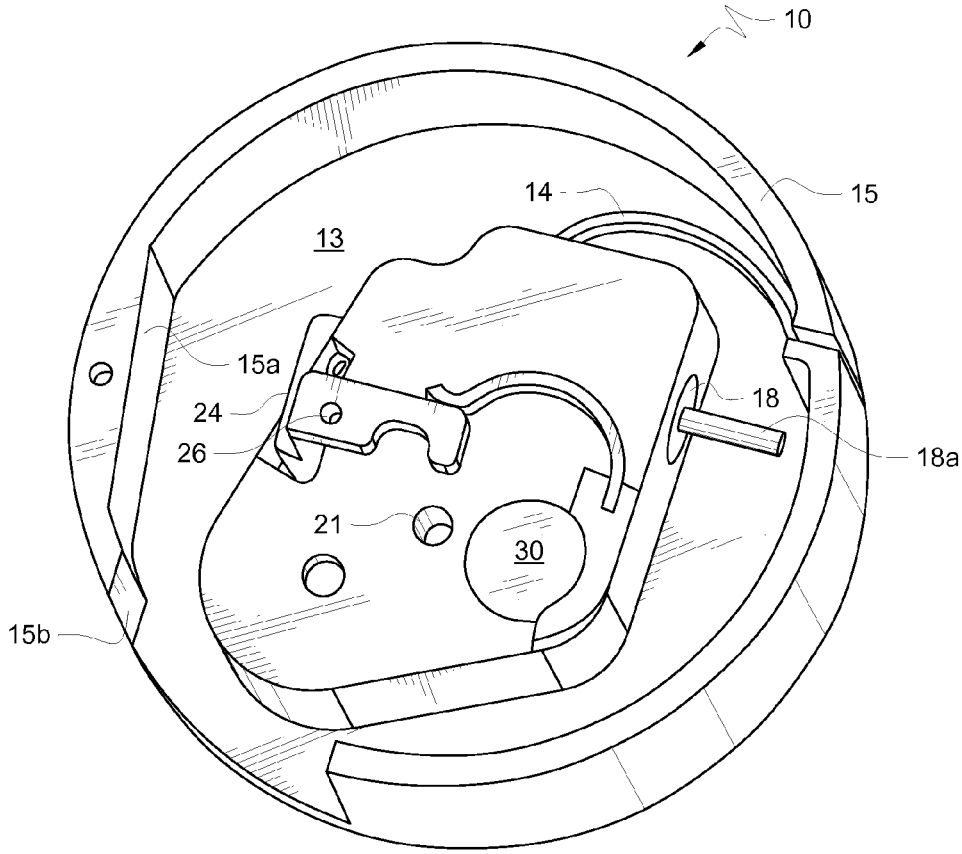
FIG. 9 is an isometric view of the assembled device with the rotor in the safe position.

FIG. 9 is an isometric view of the novel assembly with rotor 12 in its safe position.

Figure 10:
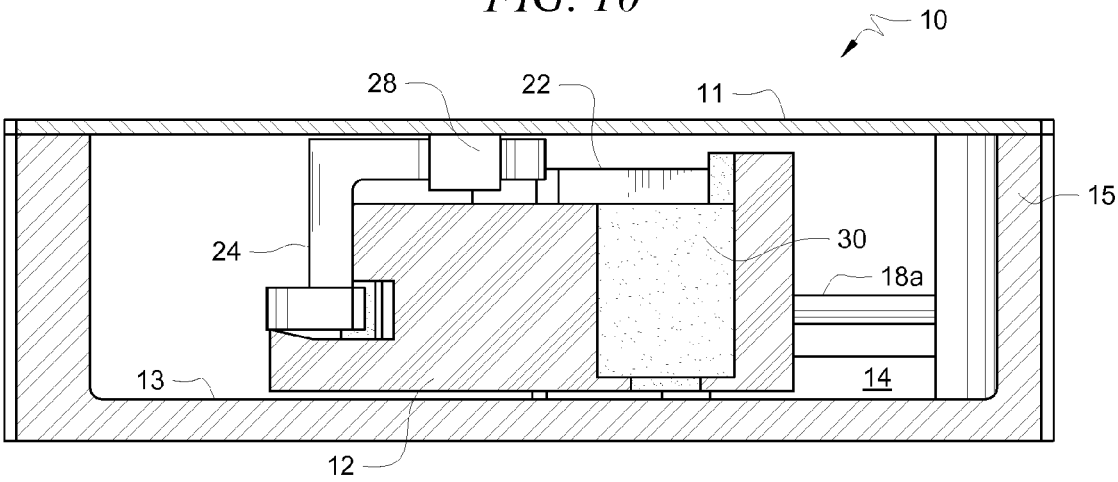
FIG. 10 is a transverse sectional view of the assembly.

FIG. 10 is a transverse sectional view of housing 10.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A command to arm apparatus, comprising:

a substantially circular housing having a flat cover, a flat bottom wall, and a peripheral sidewall that collectively define a hollow interior;

a pivotally-mounted rotor disposed in said hollow interior;

a rotor pivot pin about which said pivotally-mounted rotor is enabled to pivot, said pivotally-mounted rotor having a first, safe position of rotational adjustment that prevents detonation of an explosive;

said pivotally-mounted rotor having a second, armed position of rotational adjustment that enables detonation of an explosive;

a locking cam pivotally mounted to said rotor;

a locking cam pivot pin about which said locking cam is enabled to pivot;

a piston having a retracted position and an extended position;

said locking cam having an unpivoted position of repose in close proximity to said piston when said piston is in said retracted position;

said locking cam being substantially pivoted about said locking cam pivot pin when said piston is in said extended position;

said rotor being free to rotate about said rotor pivot pin when said locking cam is substantially rotated about said locking cam pivot pin, said rotation caused in part by revolution of said housing;

said substantially circular housing having a longitudinal axis of symmetry;

said rotor pivot pin being positioned in eccentric, spaced apart relation to said longitudinal axis of symmetry;

said rotor having a center of gravity positioned in eccentric, spaced apart relation to said longitudinal axis of symmetry and in spaced apart relation to said rotor pivot pin;

said center of gravity of said rotor being positioned in a first position southwest of said longitudinal axis of symmetry when said rotor is in said safe position; and said rotor pivot pin being positioned southeast of said rotor center of gravity and due south of said longitudinal axis of symmetry when said rotor is in said safe position.

2. The apparatus of claim 1, further comprising:

said substantially circular housing including a locking post that abuttingly engages said locking cam and prevents substantial pivotal rotation of said locking cam when said piston is in said retracted position.

3. The apparatus of claim 2, further comprising:

said abutting engagement of said locking post and locking cam having a sufficient amount of play to permit a very small amount of clockwise rotation of said rotor when a round is revolving about said longitudinal axis of symmetry in a counterclockwise direction and to permit a very small amount of counterclockwise rotation of said rotor when a round is revolving about said longitudinal axis of symmetry in a clockwise direction.

4. The apparatus of claim 2, further comprising:

said locking post depending from said flat cover.

5. The apparatus of claim 1, further comprising:

a centrifugal lock spring having a first end that engages said sidewall of said housing and a second end that engages said rotor;

said centrifugal lock spring preventing rotation of said rotor when said housing is rotating about said longitudinal axis of symmetry at a rotational speed below a predetermined threshold.

6. The apparatus of claim 1, further comprising:

a drop spring having a first end attached to said rotor and a second end disposed in abutting relation to said locking cam;

said drop spring preventing rotation of said locking cam about said locking cam pivot point when said piston is in said retracted position.

7. The apparatus of claim 6, further comprising:

a piston actuator for driving said piston from said retracted position to said extended position;

a timer for measuring an interval of time from round firing until said round achieves a predetermined no arm distance;

said piston actuator being activated by an electrical signal delivered by said timer; and said piston actuator being positioned in close proximity to said longitudinal axis of symmetry to minimize centrifugal forces acting on said piston actuator.

8. The apparatus of claim 7, further comprising;

said piston actuator having a charge sufficient to overcome the bias of said drop spring so that said piston actuator causes said piston to extend therefrom with a force sufficient to rotate said locking cam about said locking cam pivot pin;

said rotation of said locking cam about said locking cam pivot pin freeing said rotor to rotate about said rotor pivot point.

9. The apparatus of claim 1, further comprising:

an opening formed in said rotor;

a lead explosive positioned in said opening;

said lead explosive being positioned radially outwardly of said longitudinal axis of symmetry of said housing when said rotor is in said safe position; and said lead explosive having a longitudinal axis of symmetry positioned in longitudinal alignment with the longitudinal axis of symmetry of said housing when said rotor is in said armed position.

10. The apparatus of claim 1, further comprising:

a flat formed in said peripheral sidewall of said housing on a radially inward side thereof;

said rotor abutting said flat and being held against further rotation when said command to arm device is in said armed configuration.

* * * * *